US009656221B2

(12) United States Patent
Kommareddi et al.

(10) Patent No.: US 9,656,221 B2
(45) Date of Patent: May 23, 2017

(54) SYSTEMS AND METHODS FOR TREATING FLUIDS

(71) Applicant: BAKER HUGHES INCORPORATED, Houston, TX (US)

(72) Inventors: Nagesh S. Kommareddi, Tulsa, OK (US); Keith D. Fairchild, Sand Springs, OK (US); Jack B. Ward, Tulsa, OK (US); Lu-chien Chou, Tulsa, OK (US); Daniel L. Reed, Benicia, CA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 77 days.

(21) Appl. No.: 14/560,538

(22) Filed: Dec. 4, 2014

(65) Prior Publication Data

US 2015/0209738 A1 Jul. 30, 2015

Related U.S. Application Data

(60) Provisional application No. 61/931,047, filed on Jan. 24, 2014.

(51) Int. Cl.
*B01F 3/12* (2006.01)
*B01F 5/04* (2006.01)
(Continued)

(52) U.S. Cl.
CPC ..... *B01F 3/1271* (2013.01); *B01F 5/0498* (2013.01); *B01F 5/061* (2013.01);
(Continued)

(58) Field of Classification Search
CPC ..... B01F 3/1271
See application file for complete search history.

(56) References Cited

U.S. PATENT DOCUMENTS 4,340,076 A 7/1982 Weitzen
4,837,249 A 6/1989 O'Mara et al.
(Continued)

FOREIGN PATENT DOCUMENTS

DE 102010021792 A1 12/2011

OTHER PUBLICATIONS

PCT/US2014/070596—International Search Report dated Apr. 3, 2015.

*Primary Examiner* — Abbas Rashid
(74) *Attorney, Agent, or Firm* — Mossman, Kumar & Tyler PC

(57) ABSTRACT

A liquid treatment method includes mixing a liquid with an agent to form a mixture, aging the mixture to obtain to a predetermined condition in at least one of the liquid and the agent, and dispensing the aged mixture. An interaction between the liquid and the agent causes the predetermined condition to occur. Also, a majority of the aging occurs while the mixture is in a dynamic state. A related system includes a mixer receiving a liquid and a drag reducing agent and an aging module connected to the mixer. The mixer disperses the drag reducing agent in the liquid to form a mixture and the aging module has a flow path along which the mixture flows. The flow path has a distance sufficient for a majority of the aging to occur while the mixture is in a dynamic state, wherein the aging changes the drag reducing agent to a predetermined condition.

13 Claims, 4 Drawing Sheets

(51) Int. Cl.
*B01F 5/06* (2006.01)
*B01F 15/06* (2006.01)

(52) U.S. Cl.
CPC ..... *B01F 5/0647* (2013.01); *B01F 15/065* (2013.01); *B01F 2005/0636* (2013.01); *B01F 2015/062* (2013.01); *B01F 2215/0081* (2013.01)

(56) References Cited

U.S. PATENT DOCUMENTS

| | | | | |
|---|---|---|---|---|
| 4,958,653 | A | 9/1990 | Lowther | |
| 5,165,441 | A | 11/1992 | Mitchell | |
| 6,576,732 | B1 | 6/2003 | Milligan et al. | |
| 8,616,236 | B2 | 12/2013 | Burden | |
| 2006/0144595 | A1* | 7/2006 | Milligan | E21B 41/02 166/305.1 |
| 2006/0148928 | A1* | 7/2006 | Harris | F17D 1/17 523/175 |
| 2008/0047614 | A1 | 2/2008 | Hammonds et al. | |
| 2012/0004343 | A1 | 1/2012 | Burden | |

* cited by examiner

SYSTEMS AND METHODS FOR TREATING FLUIDS

CROSS-REFERENCE TO RELATED APPLICATIONS

This application claims priority from U.S. provisional application Ser. No. 61/931,047 filed Jan. 24, 2014, the entire disclosure of which is incorporated herein by reference in its entirety.

1. FIELD OF THE DISCLOSURE

This disclosure is directed to a method of treating fluids.

2. BACKGROUND OF THE DISCLOSURE

One conventional way of reducing drag in turbulent liquid streams involves injecting a slurry of drag reducing agents (DRAs) directly into the flowing stream. The DRA polymer particles in the slurry DRAs disperse into the flowing stream and dissolve over a period of time. The solubilized polymers in the DRA dampen the eddies associated with turbulent flow, and thereby reduces the drag. FIG. 1 shows an illustrative conventional system for reducing drag in a fluid line 10. The fluid line 10 may be a hose, pipeline, or other conduit suitable for conveying a fluid 12. A DRA source may dispense a DRA into the fluid line 10 at a location 16. After entering the flowing fluid, the DRA begins to dissolve. However, due to the time needed for the solid DRA particles to swell and dissolve in the flowing stream, the DRAs become only functionally effective as a drag reducer at a location 18 along the fluid line 10. Thus, there remains a portion between points 16 and 18 of the pipeline where the flowing stream does not see any meaningful drag reduction.

In certain aspects, the present disclosure addresses the need for more effectively adding DRAs into a fluid line. In certain other aspects, the present disclosure addresses the need for having an agent of any type be functionally effective at or near the point of treatment along the fluid line.

SUMMARY OF THE DISCLOSURE

In aspects, the present disclosure provides a liquid treatment method. The method may include mixing a liquid with an agent to form a mixture; aging the mixture to change at least one of the liquid and the agent to a predetermined condition, the change being caused by an interaction between the liquid and the agent; and dispensing the aged mixture.

In aspects, the present disclosure provides a liquid treatment method using a drag reducing agent. The method may include mixing a liquid with a drag reducing agent to form a mixture; aging the mixture until the drag reducing agent changes to a predetermined condition, wherein an interaction between the drag reducing agent and the liquid causes the change; and dispensing the mixture from the conduit.

In aspects, the present disclosure provides a system for treating a liquid. The system may include a mixer receiving a liquid and a drag reducing agent, the mixer configured to disperse the drag reducing agent in the liquid to form a mixture; and an aging module connected to the mixer, the aging module having a flow path along which the mixture flows, the flow path having a distance sufficient for the drag reducing agent to change to a predetermined condition.

In aspects, the present disclosure provides a liquid treatment method. The method may include mixing a liquid with an agent to form a mixture; aging the mixture to obtain to a predetermined condition in at least one of the liquid and the agent, wherein an interaction between the liquid and the agent causes the predetermined condition to occur, and wherein a majority of the aging occurs while the mixture is in a dynamic state; and dispensing the aged mixture.

In aspects, the present disclosure provides a system for treating a liquid. The system may include a mixer receiving a liquid and a drag reducing agent, the mixer configured to disperse the drag reducing agent in the liquid to form a mixture; and an aging module connected to the mixer, the aging module having a flow path along which the mixture flows, the flow path having a distance sufficient for the drag reducing agent to change to a predetermined condition, and wherein a majority of the aging occurs while the mixture is in a dynamic state in the aging module.

Examples of certain features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE FIGURES

For detailed understanding of the present disclosure, reference should be made to the following detailed description of the preferred embodiment, taken in conjunction with the accompanying drawing.

DETAILED DESCRIPTION OF THE DISCLOSURE

The present disclosure relates to methods and devices for treating a fluid with one or more agents. The present disclosure is susceptible to embodiments of different forms. The drawings show and the written specification describes specific embodiments of the present disclosure with the understanding that the present disclosure is to be considered an exemplification of the principles of the disclosure, and is not intended to limit the disclosure to that illustrated and described herein.

Figure 1:
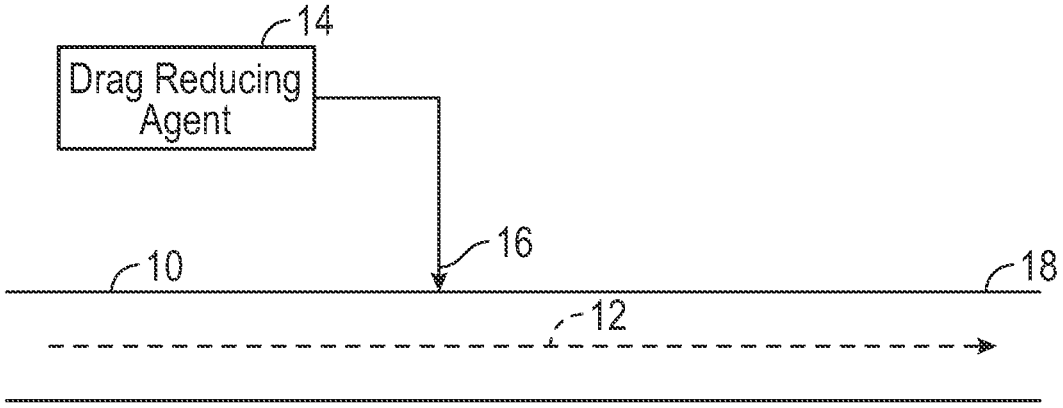
FIG. 1 (Prior Art)
FIG. 1 illustrates a prior art system for adding a drag reducing agent (DRA) to a fluid line.
Figure 2:
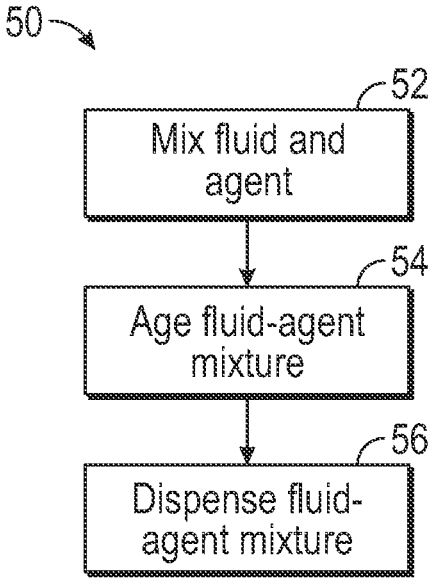
FIG. 2 illustrates a method for using a DRA to treat a fluid in a fluid line in accordance with one embodiment of the present disclosure.

Referring now to FIG. 2, there is shown a flow chart for a fluid treatment method 50 according to one embodiment of the present disclosure. The method may include a mixing step 52, an aging step 54, and a dispensing step 56. During the mixing step 52, a liquid is mixed with an agent, such as a drag reducing agent (DRA). The mixing disperses the DRA particles in the fluid body. The mixing should be contrasted with the incidental dispersal that may occur in fluid flow. Specifically, the mixing causes the DRA particles to disperse to an intentional and predetermined distribution of the DRA particles in the liquid body, which does not exist during incidental dispersal. The output of the mixing step 52 is a liquid-DRA mixture that is aged at step 54. The DRA and the liquid physically interact upon contact; i.e., the DRA begins to dissolve. During the aging step 54, this physical interaction changes the DRA from an initial non-functionally effective condition to a functionally effective condition. By functionally effective, it is meant that the DRA has reached at least thirty percent of a maximum effectiveness for the intended function, i.e., reduce drag. For example, the DRA at the end of the aging step 54 may have at least thirty percent of all DRA particles fully "uncoiled" or "expanded". At the dispensing step 56, a flowing fluid is treated with the aged mixture. From a chemical perspective, the liquid may be considered a solvent and the mixture may be considered a solution. In this instance, the DRA may be considered functionally effective after 30% dissolution. For the purposes of the present disclosure, the DRA may be considered fully dissolved after 90% dissolution.

It should be appreciated that the FIG. 2 method may provide DRA particles that are functionally effective at the time the DRA is introduced into a liquid stream to be treated. Thus, for instance, a pre-dissolved DRA polymer is almost instantaneously dissolved into the flowing stream at or near the point of treatment. As a consequence, it is possible to have near instantaneous drag reduction of the flowing stream immediately after the point of injection.

In embodiments, the steps 52, 54, and 56 are performed continuously. That is, there is a continuous flow of liquid and DRA that is being mixed, aged, and dispensed. In some embodiments, a portion of fluid is taken from a fluid line to be treated. In some instances, this fluid is referred to as a slipstream. This fluid portion is continuously mixed with DRA, aged, and then returned to the fluid line. The continuous fluid flow eliminates the need to pre-make a dissolved solution ahead of time in a large tank. Also, after an interruption in operation, the step 54 still contains the dissolved solution and will be ready to continuously impart drag reduction when operation resumes. Illustrative liquids that may be treated with DRAs include, but are not limited to, crude oil, diesel, gasoline, naphtha, natural gas liquids (NGLs), gas oil, fuel oil, vacuum gas oil, vacuum resid, kerosene, bunker fuel oil, water, hot asphalt, unprocessed liquid hydrocarbons, processed liquid hydrocarbons, etc. Illustrative and non-limiting systems that may be used to perform the FIG. 2 method are discussed below.

Figure 3:
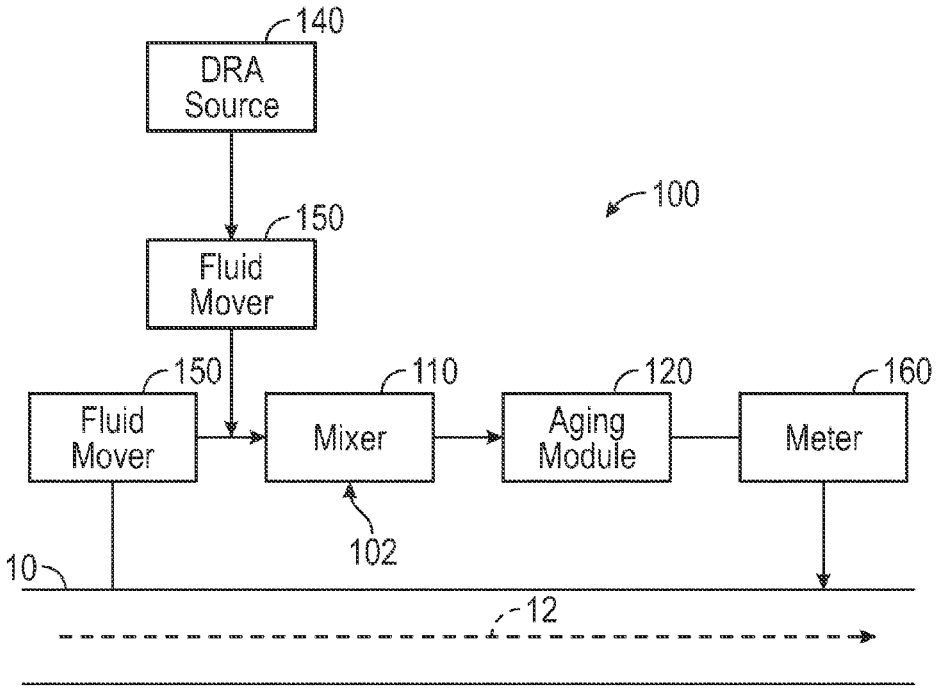
FIG. 3. schematically illustrates a liquid treatment system in accordance with one embodiment of the present disclosure.

Referring now to FIG. 3, there is shown one embodiment of a liquid treatment system 100 according to the present disclosure. The system 100 may include a mixer 110 that outputs a liquid-DRA mixture and an aging module 120 for aging this mixture. The mixer 110 receives a liquid from a fluid line 10 and a DRA from a DRA source 140. A stream of the liquid and a stream of the DRA co-mingle at a suitable connection, such as a "T-joint," and flows into the mixer 110. The mixer 110 disperses the DRA in the liquid and feeds the liquid mixture to the aging module 120. After being aged in the aging module 120, the aged mixture may be dispensed and added to the fluid line 10. For convenience, the mixer 110 and the aging module 120 may be referred to as a fluid circuit 102 because fluid may continually flow through these components.

Figure 4:
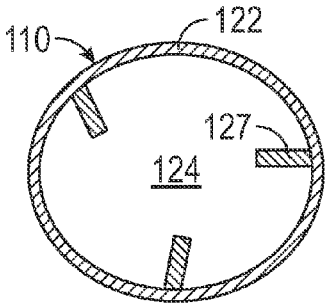
FIG. 4 illustrates a static mixer used with the FIG. 3 embodiment.

Referring now to FIG. 4, there is shown a cross-sectional view of an illustrative mixer 110 that produces a liquid-DRA mixture that can be continuously introduced into the aging module 120. The mixer 110 may be a static mixer having a body 122 and a flow bore 124. Stationary mixing elements 127 may be positioned along the flow bore 124. The mixing elements 127 may be fingers, plates, ribs, baffles, or other elements that are arranged to cause a predetermined change in liquid flow direction along the flow bore 124. These predetermined changes in liquid flow disperse the DRA particles in the liquid body until a desired spatial distribution of DRA particles in the liquid body is obtained. It should be noted that the mixer 110 disperses the DRA particles using the pressure differential in the fluid flowing across the mixer 110. That is, the mixer 110 does not use an external power source, such as electrical power, fuel combustion, or pneumatic power, to perform the mixing. Rather, the mixer 110 uses the energy available in the flowing fluid. In some embodiments, an active mixer, such as an agitator that has moving blade, may be used to generate the mixture.

Figure 5:
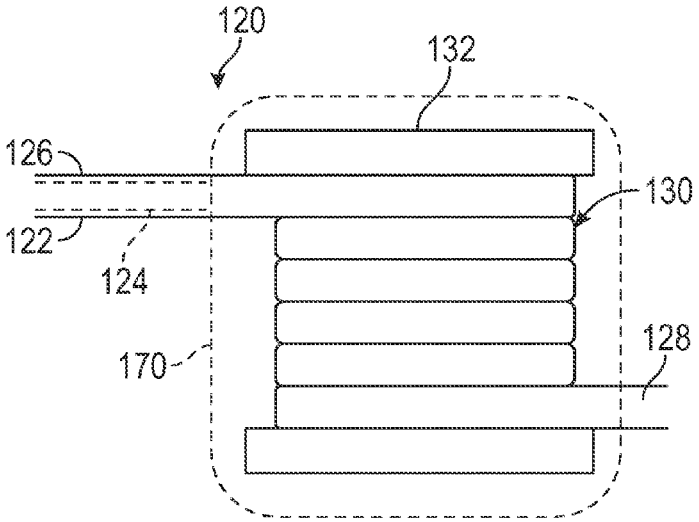
FIG. 5 illustrates a conduit used with the FIG. 3 embodiment.

Referring now to FIG. 5, there is shown one embodiment of an aging module 120 that may be used to age the liquid-DRA mixture produced by the mixer 110. The aging module 120 is configured to age the liquid-DRA mixture, or other mixture, to obtain to a predetermined condition in either or both of the liquid and the DRA (agent). It is an interaction between the liquid and the agent that causes the predetermined condition to occur. The aging module 120 may include a tubular 122 having a flow path 124, such as a bore, a portion of which is shown in dashed lines. The mixture enters at an inlet 126 and exits at an outlet 128. The distance between the inlet 126 and the outlet 128 may be selected to provide a fluid residency time in the aging module 120 that allows the DRA in the mixture to reach the functionally effective condition. By way of example, it may be determined that at least sixty minutes is needed for the DRA to reach a functional effective condition after contacting the liquid. If the mixture flows at one foot per second through the aging module 120, then the distance may need to be a least 3,600 feet between the inlet 126 and the outlet 128. To obtain the desired distance, the aging module 120 may include a circuitous portion 130. The circuitous portion 130 may include a number of configurations that lengthen the distance between the inlet 126 and the outlet 128. For example, the tubular 122 may include a number of U-shaped bends that allows the tubular to fold in a zig-zag fashion. In the arrangement shown, the circuitous portion 130 is wound into a helical or spiral shape around a spool 132. Thus, the circuitous portion 130 is mostly non-linear. The tubular 122 may be a coilable tubing made of metal, plastic, composites, or any other suitable material.

Figure 6A:
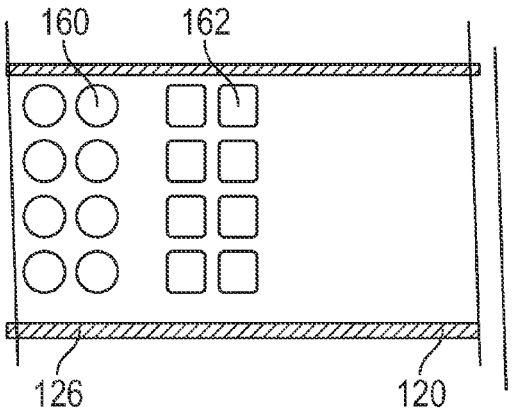
FIGS. 6A-C illustrate types of flow across a fluid line.
Figure 6B:
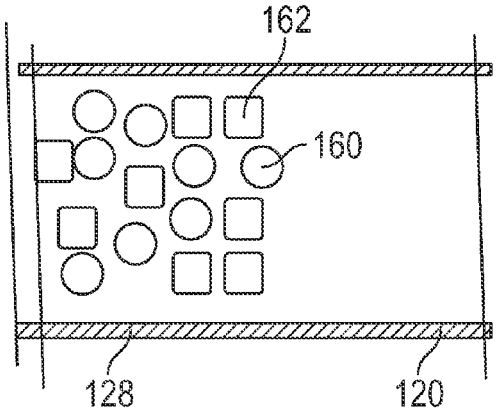
Figure 6C:
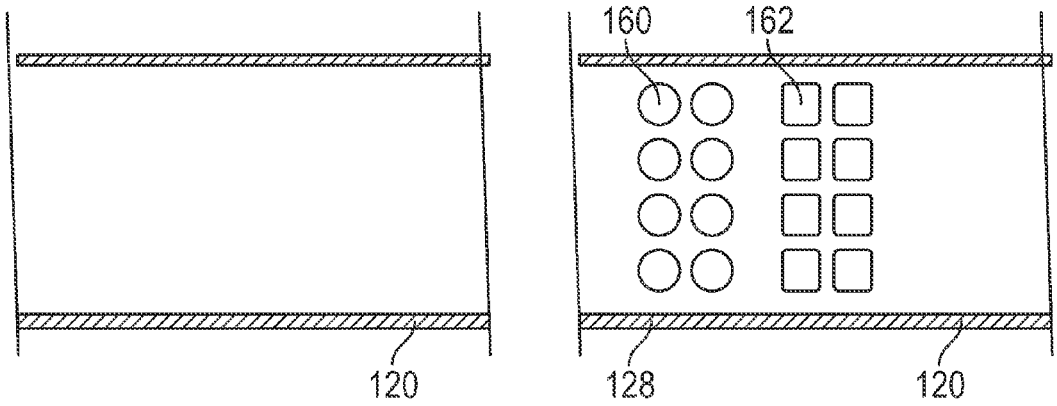

In addition to providing a desired residency time, the aging module 120 may be configured to generate a plug flow in the flow path 124. Referring now to FIG. 6A, there is sectionally shown a fluid in the aging module 120. Merely for illustration, two fluid portions are shown, the fluid portions shown in circles 160 entered the aging module 120 at the inlet 126 after the fluid portions shown in squares 162 entered the fluid line. If uncontrolled, the flow in the aging module 120 may alter such that some of the fluid portions 160 channel through the fluid portions 162. In FIG. 6B, some of the later entering fluid 160 has channeled through and passed some of the earlier entering fluid 162. Thus, some portions of the fluid 162 may collect or otherwise impede flow in the aging module 120. However, embodiments of the present disclosure use an aging module 120 that has a flow path 124 (FIG. 5) configured to maintain a plug flow. As shown in FIG. 6C, in plug flow, the fluid bodies 160, 162 move substantially in unison and there is minimal channeling. Thus, little if any of the fluid mixture collects or obstructs the aging module 120. In embodiments, the flow path 124 (FIG. 5) may use a geometry wherein the flow path profile does not substantially change (e.g., increase or decrease in size) and there are minimal elbows or other disruptive changes in flow direction that could destabilize plug flow.

In some embodiments, the aging module 120 ages the fluid mixture while the fluid mixture is being conveyed between two separate locations. In other embodiments, the aging module 120 ages the fluid mixture while the fluid mixture is being conveyed between two separate locations and also while the fluid mixture is held in a static state in a tank or container. For instance, the fluid mixture may be aged while flowing the coilable tubular. The coilable tubular may feed the aged mixture into one more tanks. The fluid mixture may be further aged in the tank(s) for a specified time. Thereafter, a feed line may draw the aged mixture form the tank(s) for dispensing. Where two or more tanks are used, the feed line may draw the fluid mixture from one tank while the fluid mixture is being aged in the second tank. In such embodiments, the fluid mixture is aged while in a dynamic state in the coilable tubular and a static state while in the tank(s). In arrangements, a majority of the aging is done in the dynamic state and a minority of the aging is done in a static state. In other embodiments, the percentage of aging the dynamic state may be 60%, 70%, 80%, 90%, or 95%.

As used above, the term "dynamic state" refers to a state wherein the fluid flows from one discrete location to another discrete location. Fluid moving through tubing is an example of a fluid in a dynamic state. The term "static" state refers to a state wherein the fluid remains in one discrete location. A fluid in a static state may be still or be agitated. Thus, a fluid in a dynamic state can be considered as being conveyed between two points whereas a fluid in a static state can be considered as being confined to one point. Fluid held in a container is an example of a fluid in a static state.

Referring back to FIG. 3, in some arrangements, the pressure in the fluid line 10 may be sufficient to energize fluid flow through the fluid circuit 102. In other arrangements, one or more fluid movers 150 may be used to flow liquids through the fluid circuit 102. As used herein, a fluid mover is any device that adds energy to liquid to induce fluid flow. Illustrative, but not exhaustive, fluid movers include centrifugal pumps, turbines, piston pumps, etc. As shown, fluid movers 150 may be used to pump liquid from the fluid line 10 and from the DRA source 140 to the mixer 110. Also, a metering device 160 may be used to dispense the aged mixture into the fluid line 10. The metering device 160 may include a peristaltic pump or piston pump or other suitable metering device that adds a predetermined amount of the aged mixture to the fluid line 10. The dispensing may be continuous or intermittent. The metering device 160 may include a pump to overcome the pressure of the liquid in the fluid line 10 in order to dispense the aged mixture. Of course, the liquid treatment system 100 may include other devices such as sensor, gauges, and valves known to those skilled in the art.

It should be understood that the present disclosure is susceptible to a number of variants. For example, the temperature of the aging module 120 may be controlled to accelerate the dissolution of the DRA in the liquid. Referring to FIG. 5, the aging module 120 may be at least partially subjected to a heat bath 170. For example, the tubular 122 may be immersed into a hot oil bath to maintain temperature at say forty degrees Celsius. Such an application may be particularly suited for treated diesel in pipelines in very cold conditions. The pre-dissolved DRA mixture would instantaneously dissolve into the cold stream in the fluid line 10 and not face the extended lag time in dissolution faced by the DRA particles when directly injected into the cold diesel stream. The heat may also be provided by fans blowing hot air, by electrically energized coils, or any other heat generating device.

Figure 7:
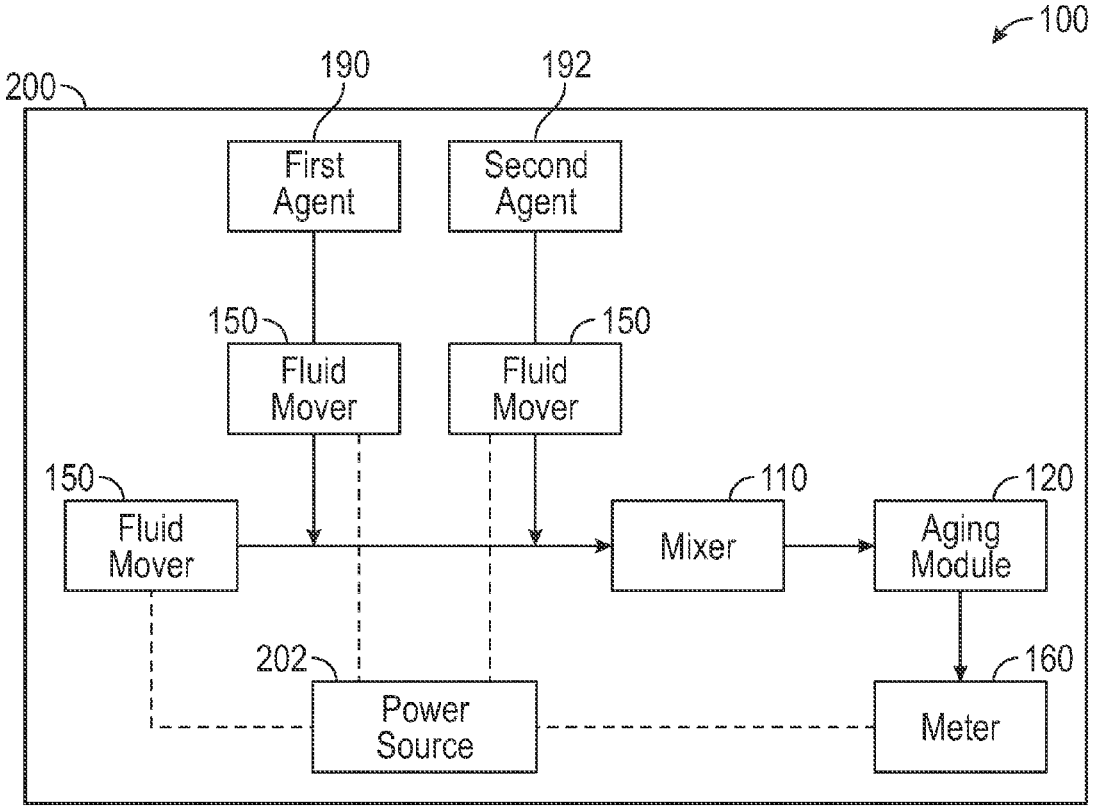
FIG. 7 schematically illustrates a portable liquid treatment system in accordance with one embodiment of the present disclosure.

Referring now to FIG. 7, there is shown another non-limiting embodiment of the present disclosure. In this embodiment, the liquid treatment system 100 is portable and configured to add two or more agents to a fluid. The agents, which may be the same or different, are supplied by sources 190, 192. For instance, the source 190 may supply a DRA and the source 192 may supply an agent that change lubricity. In such an arrangement, the system may be used to adjust lubricity and the DRA may be used to accelerate the treatment process. It should be understood, that three or more agents may be added and that DRA do not necessarily have to be one of those agents. The system 100 may be made portable, by positioning the mixer 110, the aging module 120, the fluid movers 150, and the meter 160 on a skid 200. Optionally, a power source 202 may also be positioned on the skid 200. The skid 200 may be a frame, plate, platform, or other suitable structure configured to be moved by a vehicle between two or more locations. The skid 200 may be a single structure or two or more structures. The power source 202 may be a self-contained electrical power generator that uses a motor to generate electrical power that energizes devices like the fluid movers 150 and the meter 160.

The particular configuration for the system 100 may be determined experimentally. For example, a test was performed with diesel and a drag reducer slurry product. These components were introduced into a mixing tee that feeds a static mixer. The configuration of the static mixer was selected to obtain the desired dispersal of the DRA particles into the diesel stream. Downstream of the static mixer was a compact bundle of coiled tubing made up of tube diameters ranging from 0.5 inch OD to 0.75 inch OD. The total length of the compact coiled tubing was about 3900 ft (approx. 0.73 miles) and fitted inside a spool piece having dimensions of about 46 inch×36 inch×30 inch. This compact coiled tubing provided residence time in excess of 2 hours while feeding the diesel at 19 gallons per hour and the DRA slurry at 1 gallon per hour. The exiting stream had about 1 wt % fully dissolved DRA polymer and was found to be uniform in composition and consistent in activity. It is cautioned that that the methods, devices and systems of the present disclosure are not limited to the configuration tested. Rather, the discussion of the test is provided merely to further describe the teachings of the present disclosure.

From the above, it should be appreciated that the present disclosure provides, in part, a compact, continuous and portable system for mixing the DRA with the liquid, dissolving the DRA particles into the liquid, and re-injecting the dissolved DRA solution into a fluid line. The portable embodiments of the present disclosure enable services to be delivered on an as needed basis, for example when a ship containing a liquid stream needs to be un-loaded. As noted above, systems of method of the present disclosure may provide for faster unloading times by drag reducing the pipeline containing the flowing stream. However, a similar benefit may be obtained for loading of the ships or barges or other vessels from storage terminals. In any short transfer lines, the fluid transfer process may be sped by the adding a functionally effective DRA into the fluid transfer lines. Further, inside refineries or other fluid processing facilities, there are several liquid streams that are produced and transferred resulting in periodic bottlenecks based on the operations. Systems and methods of the present disclosure may provide for a just in time debottlenecking as needed. Moreover, the compactness may be useful from a footprint perspective in tight spaces. The unit can be moved around inside refineries to where the de-bottlenecking is needed.

While the present disclosure has been discussed in connection with drag reducing agents, the present teachings may be applied to any situation the requires using an agent that must be changed from an inactive to a active condition before use. One or more of these agents may be used to treat either a flowing fluid or a non-flowing fluid. In some of these situations, it may be impractical to pre-mix and pre-age the agent to be used for fluid treatment. Advantageously, systems and methods of the present disclosure activate the agent and age the agent on-site, which allows the agent and/or the liquid interacting with the agent to change to a functionally effective condition only when needed.

Thus, the drag reducing agents discussed above are merely illustrative of the type of agents that may be used with the present disclosure. An illustrative, but not exhaustive, types of agents include a suspension or slurry, a latex, a long-chain hydrocarbon polymer, a long chain polyalkyl methacrylate, a long chain polyalkyl acrylate, a long chain polyacrylamide, a long chain poly ethylene oxide, and a long chain poly-alpha-olefin.

The types of changes that the agent and/or the liquid may undergo include, but are not limited to, dissolution, an increase in volume, uncoiling, swelling, expanding, an change in viscosity, a change in haze or visual clarity, a change in corrosivity, a change in lubricity, a change in conductivity, a change in odor, a change in biological activity, precipitation, and a change in suspended water content.

The term "fluid" or "fluids" includes liquids, gases, hydrocarbons, multi-phase fluids, mixtures of two of more fluids, crude oil, refined crude oils, liquid hydrocarbons, refined hydrocarbons, diesels, gasoline, engineered liquids, etc.

From the above, it should be appreciated that what has been described includes a liquid treatment method that includes the steps of mixing a liquid with an agent to form a mixture; aging the mixture to change at least one of the liquid and the agent to a predetermined condition; and dispensing the aged mixture. The change may be caused by an interaction between the liquid and the agent. The mixing, aging, and dispensing may be done continuously and sequentially. Also, the mixing, aging, and dispensing may be performed along a fluid circuit. Some methods may include causing a plug flow condition in at least a portion of the conduit. Methods may also include controlling a temperature of the mixture in the conduit.

The predetermined condition may be one or more of: (i) a volume change, (ii) a dissolution, (iii) a viscosity change, (iv) a change in haze or visual clarity, (v) a change in corrosivity, (vi) a change in lubricity, (vii) a change in conductivity, (viii) a change in odor, (ix) a change in biological activity, (x) a precipitation, and (xi) a change in suspended water content.

The fluid circuit may include a static mixer that substantially disperses the agent in the liquid. The fluid circuit may also include a conduit having a flow path, a majority of the flow path being non-linear, and wherein the mixture is aged in the flow path. The method may further include continuously flowing the mixture through the flow path. Further, a time spent aging is longer than a time spent mixing. The mixing may be performed in a static mixer and the aging may be performed in a tubular connected to static mixer. The static mixer and the tubular form a treatment system. In some methods, the time spent aging the mixture may be at least ten times longer than a time spent mixing the mixture.

In some methods, a drag reducing agent may be used to form a mixture. The drag reducing agent may include one of: (i) a suspension or slurry (ii) a latex, (iii) a long-chain hydrocarbon polymer; (iv) a long chain polyalkyl methacrylate, (v) a long chain polyalkyl acrylate; (iii) a long chain polyacrylamide (iv) a long chain poly ethylene oxide, and (v) a long chain poly-alpha-olefin. In such embodiments, the method may include estimating a time required to change the drag reducing agent to the predetermined condition after the drag reducing agent is mixed with the liquid, wherein the aging time is at least as long as the estimated time.

From the above, it should be appreciated that what has been disclosed also includes a system for treating a liquid. The system may include a mixer receiving a liquid and a drag reducing agent, the mixer configured to disperse the drag reducing agent in the liquid to form a mixture; and an aging module connected to the mixer, the aging module having a flow path along which the mixture flows, the flow path having a distance sufficient for the drag reducing agent to change to a predetermined condition. The system may also include one or more fluid movers configured to continuously flow the mixture through the aging module. The fluid mover may include a first fluid mover pumping the liquid to the mixer and second fluid mover pumping the drag reducing agent to the mixer. In arrangements, at least one dimension associated with the flow path is selected to induce a plug flow along at least a portion of the flow path. A majority of the flow path may be non-linear. Also, at least a portion of the flow path may have a geometry selected from one of: (i) spiral, and (ii) helical (iii) a compact series of hair pin bends. The mixer may be a static mixer having at least one stationary flow element contacting the flowing liquid and drag reducing agent, the at least one stationary element disrupting the flow to cause dispersion of the drag reducing agent in the flowing fluid. The mixer may disperse the drag reducing agent primarily by using an energy associated with a pressure drop across the mixer.

In arrangements, the system may include a meter selectively dispensing the aged mixture from the aging module. Arrangements may also include a feed line in fluid communication with the mixer, the feed line supplying the liquid. The feed line and the meter may be configured to connect to a fluid line, the feed line being configured to draw the fluid from the fluid line and the meter being configured to dispense the aged mixture into the fluid line. The feed line may be further configured to continuously draw the fluid while the meter dispenses the aged mixture into the fluid line. In arrangements, a distance the fluid flows from the fluid line to the mixer is shorter than a distance the mixture flows from the mixer to the fluid line. The fluid line may be one of: (i) a rigid pipeline, (ii) a transportable hose; and (iii) a fluid line receiving a liquid from a tank on a transport vehicle.

While the foregoing disclosure is directed to the preferred embodiments of the disclosure, various modifications will be apparent to those skilled in the art. It is intended that all variations within the scope of the appended claims be embraced by the foregoing disclosure.

What is claimed is:

1. A liquid treatment method for treating a flowing fluid, comprising:

retrieving a slip stream from the flowing fluid;

mixing the slip stream with a drag reducing agent to form a mixture;

pumping the mixture into an aging module;

aging the mixture in the aging module to obtain to a predetermined condition in at least one of a liquid of the slip stream and the agent, wherein an interaction between the liquid and the agent causes the predetermined condition to occur, and wherein a majority of the aging occurs while the mixture is in a dynamic state; and dispensing the aged mixture into the flowing fluid, wherein the aging module is a coiled tubular wound around a spool.

2. The method of claim 1, wherein the mixing is done with a static mixer using an energy available in the flowing fluid and not an external power source.

3. The method of claim 1, further comprising:

estimating a time required to change the drag reducing agent to the predetermined condition after the drag reducing agent is mixed with the liquid, wherein the aging time is at least as long as the estimated time; and flowing the mixture in the aging module for at least the estimated time.

4. The method of claim 1, wherein the dispensing is done by metering the aged mixture into the flowing fluid using a meter configured to dispense a predetermined amount of the aged mixture into the flowing fluid, wherein the aging module is a coiled tubular conveying the aged mixture to the meter.

5. The method of claim 4, wherein the meter includes a pump.

6. The method of claim 1, wherein the predetermined condition is at least one of: (i) a volume change, (ii) a dissolution, (iii) a viscosity change, (iv) a change in haze or visual clarity, (v) a change in corrosivity, (vi) a change in lubricity, (vii) a change in conductivity, (viii) a change in odor, (ix) a change in biological activity, and (x) a change in suspended water content.

7. The method of claim 1, wherein the mixing, aging, and dispensing are done continuously and sequentially while the mixture flows along a fluid circuit.

8. The method of claim 7, further comprising causing a plug flow condition in at least a portion of the fluid circuit.

9. The method of claim 1, wherein the mixture is aged for at least a time period sufficient to cause a substantial change in a fluid parameter of the mixture, the fluid parameter being selected from at least one of: (i) viscosity, (ii) shear strength, (iii) lubricity, (iv) a change in haze or visual clarity, (v) a change in corrosivity, (vi) a change in lubricity, (vii) a change in conductivity, (viii) a change in odor, (ix) a change in biological activity, and (x) a change in suspended water content.

10. The method of claim 1, wherein the predetermined condition is one of: (i) uncoiling, (ii) swelling, and (iii) expansion.

11. The method of claim 1, further comprising controlling a temperature of the mixture by one of: (i) adding thermal energy to the mixture, and (ii) removing thermal energy from the mixture.

12. The method of claim 1, wherein the drag reducing agent includes one of: (i) a suspension or slurry (ii) a latex, (iii) a long-chain hydrocarbon polymer; (iv) a long chain polyalkyl methacrylate, (v) a long chain polyalkyl acrylate; (iii) a long chain polyacrylamide (iv) a long chain poly ethylene oxide, and (v) a long chain poly-alpha-olefin.

13. The method of claim 1, wherein at least 80% of the aging occurs while the mixture is in a dynamic state.

* * * * *